US012252861B2

(12) United States Patent
Trout

(10) Patent No.: US 12,252,861 B2
(45) **Date of Patent: *Mar. 18, 2025**

(54) SOIL EXTRACTION/GROUTING DEVICE

(71) Applicant: The Trout Group, Inc., Geneva, IL (US)

(72) Inventor: Steven M. Trout, Geneva, IL (US)

(73) Assignee: The Trout Group, Inc., Geneva, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/314,511

(22) Filed: May 9, 2023

(65) Prior Publication Data

US 2023/0272589 A1 Aug. 31, 2023

Related U.S. Application Data

(62) Division of application No. 17/469,389, filed on Sep. 8, 2021, now Pat. No. 11,686,061.

(51) Int. Cl.
*E02D 3/12* (2006.01)
*E02F 3/92* (2006.01)

(52) U.S. Cl.
CPC ..... *E02D 3/12* (2013.01); *E02F 3/9262* (2013.01); *E02D 2250/003* (2013.01)

(58) Field of Classification Search
CPC ..... E02D 3/12; E02D 3/126; E02D 2250/003; E02D 5/18; E02D 5/44; E02F 3/9218; E02F 3/9225
See application file for complete search history.

(56) References Cited

U.S. PATENT DOCUMENTS

| | | | | |
|---|---|---|---|---|
| 3,608,317 | A * | 9/1971 | Landau | E21B 33/13 175/394 |
| 3,938,344 | A | 2/1976 | Asayama | |
| 4,640,649 | A | 2/1987 | Nakanishi | |
| 5,141,366 | A | 8/1992 | Ishida et al. | |
| 5,219,246 | A | 6/1993 | Coutts et al. | |
| 5,294,215 | A | 3/1994 | Millgard | |
| 5,396,964 | A | 3/1995 | Shellhorn et al. | |
| 5,399,056 | A | 3/1995 | Shibazaki et al. | |

(Continued)

FOREIGN PATENT DOCUMENTS

JP 60062322 A 4/1985

*Primary Examiner* — Benjamin F Fiorello
(74) *Attorney, Agent, or Firm* — TAYLOR & EDELSTEIN

(57) ABSTRACT

A method of moving an underground pipeline including the steps of: driving a casing into a soil proximate to the pipeline; deploying a pivoting wand from the casing about a pivoting axis, the pivoting wand having a plurality of cutting nozzles that are coupled to a fluid conduit having a longitudinal extent in the casing relative to a longitudinal axis; pressurizing the fluid conduit to thereby send fluid through the cutting nozzle to soften the soil in a direction in which the wand deploys; rotating the pivoting wand; conducting the softened soil up through the casing to form a cavity in the soil proximate the pipeline, the cavity in the soil having a shape reflective of the movement of the pivoting wand in the rotating step; positioning a lifting device beneath the pipeline. And, lifting the pipeline with the lifting device thereby drawing the pipeline toward or into the cavity.

20 Claims, 8 Drawing Sheets

(56) References Cited

U.S. PATENT DOCUMENTS

| | | | | |
|---|---|---|---|---|
| 5,411,353 | A | 5/1995 | Taki | |
| 5,484,233 | A | 1/1996 | Kunito | |
| 5,503,501 | A | 4/1996 | Kunito | |
| 5,645,376 | A | 7/1997 | Taki | |
| 6,685,398 | B1 | 2/2004 | Gunther | |
| 7,695,218 | B2 | 4/2010 | Maione | |
| 11,686,061 | B2 * | 6/2023 | Trout | E02D 3/12 405/266 |
| 2006/0275087 | A1 | 12/2006 | Trout | |
| 2011/0188947 | A1 | 8/2011 | Biserna | |
| 2014/0178132 | A1 | 6/2014 | Koehler et al. | |
| 2017/0204581 | A1 | 7/2017 | Darson Balleur et al. | |
| 2019/0162353 | A1 | 5/2019 | Trout et al. | |

* cited by examiner

SOIL EXTRACTION/GROUTING DEVICE

CROSS REFERENCE TO RELATED APPLICATIONS

This is a division of U.S. patent application Ser. No. 17/469,389, entitled "SOIL EXTRACTION/GROUTING DEVICE", filed Sep. 8, 2021, which is incorporated herein by reference. The foregoing application being incorporated by reference.

BACKGROUND OF THE INVENTION

1. Field of the Invention

The present invention relates to a soil extraction/grouting device, and, more particularly, to a soil extraction/grouting device which can be used to improve the density/stability of soils, and which can thereby stabilize the soils and overlying structures and/or lift and stabilize a structure and infrastructure or a pipeline which has become unstable or has settled due to a weak or unstable underlying soil conditions. Additional purposes include soil extraction to remove weak soils such as peat or other very compressible soils then replaced by non-compressible products such as cementious or foam grouts. Another use is to remove contaminated soils or water/solutions for remediation purposes.

2. Description of the Related Art

Uniform soil foundation support has challenged civilization since man first set stone on stone for shelter, worship, landmark, or as a burial monument. The problem of differential settlement in structures supported on the ground is a very common problem experienced all over the world.

The forces of nature have resulted in the soil material covering our continent to be extremely variable. Some soil types are stable and provide excellent bearing support for structural foundation support while many areas lack the uniform characteristics that are needed to secure uniform bearing capacity. There are a wide range of conditions that contribute to the variability of soil bearing capacity.

Over time, as municipalities expand into less and less favorable lands for expansion development, with predictable and inevitable effects of distress on infrastructure and buildings, above- and below-grade utilities and structures alike are affected. In some instances when cost constraints are so prohibitive, typically due to the limits of poor soils, excavation and replacement is one method performed.

Other methods include piering, piles, or rammed aggregate piers to name a few, to support structures but rarely utilities. Other times, for cost savings, sites designated for redevelopment consist of urban fill and new infrastructure and structures are erected with minimal soil treatment if at all. Ultimately all, to varying degrees, experience structure and utility distress due to settlement.

In the last 50 years, soil grouting and ground modification advancements have surpassed most design and engineering professional's imaginations. Advancements in products, procedures, equipment, and design have allowed for the installation of structures for new development and restoration of infrastructure where once unimaginable; however, even the most advanced applications have limits of what can be accomplished within the ability of today's allowable features.

What we know is that soils still, in most instances if not all, dictate what can or cannot be done; however, this recent development which involves a variation and combination of soil pre-treatments, soil extraction, and the replacement or introduction of products can raise below- and above-grade elements and structures or lower to a compromise level. Soils can be removed, remediated, and replaced.

The grouting technique most often used for densifying soils and urban fill is referred to as "compaction grouting". This process uses a low-slump grout placed at controlled high pressure to strengthen low strength soils by displacement and densification of the soil. Settlement is corrected by placing additional grout volumes at controlled high pressure under carefully monitored and controlled procedures.

A similar process growing in popularity due to its simplicity and cost savings is the use of expanding polyurethane foams to densify weak soils.

Unfortunately, the prior art requires many steps requiring the management of: the volume of grout material placed; the high pressure required; and the development of confinement in the treated zone for grout and ground pressure-induced densification response within the targeted soil. Another soil property that impacts the application of pressure-injected grout for foundation stabilization and raising of settled structures is soil density. If the targeted soil is relatively dense, the grout injection process can be very difficult as high pressures are required and process control is compromised under these dense soil conditions.

Ground responses can be very quick and can jeopardize the structure and the safety of the installers. As a result of dense soil conditions, a particular application site may not have a soil profile or soil condition where pressure-injected grout material would be well suited for correcting all, or a portion of, the problem.

It is often desirable to densify soils for the purpose of stabilizing the soils. Soft soils, such as loose sand and mixtures which include sand, are unstable and will often allow a structure to sink or crack due to lack of uniform support of the foundation.

One method of densifying soil is to pump a low slump cementitious or chemical grout into the ground through a pipe driven beforehand. If a cementitious grout is used, it is placed under a high pressure so that it compacts the soil as it displaces it. Chemical grouts on the other hand, typically increase a soil's density by permeating and hardening in a porous soil after they are in place, but they will not raise a structure.

The low slump technique, called compaction grouting, is used to raise a foundation, or a segment thereof if settlement has not been uniform. To do so, the grout pressure is increased and focused on the soils in direct support of the foundation. A difficulty with the procedure is that if the soil condition is not uniform, and few are, the grout tends to flow laterally in fingers or lenses through the most porous soil. When this is the case, a relatively large volume of material must often be placed at high pressures before there is adequate confinement to exert pressure within the targeted soil if a all. In some instances, failure to contain the grout in close proximity to the underside of the element to be raised can adversely affect adjacent utilities of structures.

Another difficulty is that if the targeted soil is relatively dense, it will not be wholly penetrable. As a result, a particular area may not yield the profile desired to direct the maximum hydraulic force vertically. If for example, the strata permits only 20% penetration of the soil in direct support of a foundation, the grout pressure must be five times as great as would be required if the grout pressure could be fully directed on the soil directly beneath the foundation.

Piers and piles are known systems which are primarily used for residential and light commercial applications. Installations require engineers to design their installation, and building permits, because piers change the design function of the structure by raising the structures footings off the soil. The voids created beneath the footing allow water to accumulate and migrate under the footing thereby compromising the load bearing capacities of unsupported areas. Jacking a structure with pilings or piers causes point loading of a foundation, a situation for which the foundation is not designed. This point loading often causes foundations to crack. Jacking systems are also often limited to concrete structures, and are not useable with most block, stone, and brick foundations. These systems require excavation to the depth of the footing for installation often with medium heavy-duty equipment. The procedure requires days to install, disruption, slab removal, and is usually limited to concrete structures. Pier and pile loads are also much less than the structure itself could carry as designed, even if on competent soil.

Compaction grouting is a known process which is most applicable to stabilization of fine-grained soils and can also be used to raise structures which have settled. Its primary use is for soil densification and foundation raising. Due to the lack of lateral confinement, compaction grouting is generally not effective nearer than about 15 foot (4.6 m) of the surface or an unrestrained down slope. Although densification and raising are obtainable through compaction grouting, it is limited to a single soil condition, expensive, requiring extensive investigation, planning, engineering, and with varying results. It too has difficulty lifting masonry, brick or stone foundations due to the possibility of causing potential damage.

Known chemical grouts typically increase a soil's density by expanding or hardening in a porous soil after they are in place, but they will not raise a structure. Known methods/devices of densifying a soil by simply pumping grout into the soil has the disadvantages of being very dependent on the porosity of the soil, which can require very high grout pressure to produce an adequate hydraulic lift, and/or require a relatively large volume of grout material.

Other disadvantages of conventional methods are that the results, feasibility, pressure application, performance, duration, costs, difficulty, disruption, material consumptions, and grout volumes are dictated by soil conditions.

What is needed in the art is an extraction/grouting device which can be used efficiently and effectively to provide support and movement in a variety of structures.

SUMMARY OF THE INVENTION

The present invention provides an extraction/grouting device which can be used efficiently and effectively to provide lifting and support for a variety of structures.

The invention comprises, in one form thereof, a method of moving an underground pipeline including the steps of: driving a casing into a soil proximate to the pipeline; deploying a pivoting wand from the casing about a pivoting axis, the pivoting wand having a plurality of cutting nozzles that are coupled to a fluid conduit having a longitudinal extent in the casing relative to a longitudinal axis; pressurizing the fluid conduit to thereby send fluid through the cutting nozzle to soften the soil in a direction in which the wand deploys; rotating the pivoting wand; conducting the softened soil up through the casing to form a cavity in the soil proximate the pipeline, the cavity in the soil having a shape reflective of the movement of the pivoting wand in the rotating step; positioning a lifting device beneath the pipeline. And, lifting the pipeline with the lifting device thereby drawing the pipeline toward or into the cavity.

The invention comprises, in yet another form thereof, a buried pipeline lifting system including an extraction/grouting system and a pipeline lifting device. The extraction/grouting system includes, a fluid conduit having a longitudinal extent along a longitudinal axis; a pivoting wand; a plurality of cutting nozzles in fluid communication with the fluid conduit, the cutting nozzles being coupled to the pivoting wand that is pivotably extendable relative to the longitudinal axis; and a casing, the extraction/grouting device being movably extended at least partially within the casing. The extraction/grouting system is used to carry out the following steps: driving at least one casing into a soil proximate to the pipeline; deploying a pivoting wand from the casing about a pivoting axis, the pivoting wand having a plurality of cutting nozzles that are coupled to a fluid conduit having a longitudinal extent in the casing relative to a longitudinal axis; pressurizing the fluid conduit to thereby send fluid through the cutting nozzle to soften the soil in a direction in which the wand deploys; rotating the pivoting wand; and conducting the softened soil up through the casing to form a cavity in the soil proximate the pipeline, the cavity in the soil having a shape reflective of the movement of the pivoting wand in the rotating step. The pipeline lifting device is used to carry out the following steps: positioning the pipeline lifting device beneath the pipeline; and lifting the pipeline with the pipeline lifting device thereby drawing the pipeline toward or into the cavity.

An advantage of the present invention is that it can be used to raise a structure such as a pipeline.

Another advantage of the present invention is that it is not dependent on the porosity of the soil in which it is acting on.

Yet another advantage of the present invention is that it requires less grout pressure for the same amount of hydraulic lift, when compared to other methods/devices.

Yet another advantage of the present invention is that it requires less grout for the same amount of hydraulic lift, when compared to other methods/devices.

Yet another advantage of the present invention is that there is minimal disruption of surrounding soils and structures since is not required.

Yet another advantage of the present invention is that there is minimal duration of the extraction/grouting process since excavation starting from the soil surface is not required.

Yet another advantage of the present invention is that the pipe and/or casing may also be left in place to expedite ongoing operations.

Yet another advantage of the present invention is that densification and raising results are predictable.

Yet another advantage of the present invention is that structures other than buildings, such as roads and pipelines, can be lifted.

Yet another advantage if the present invention is far less likely to cause lateral damage to surrounding structures or utilities than conventional methods devices due to the forces being directed more vertically, and not laterally.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
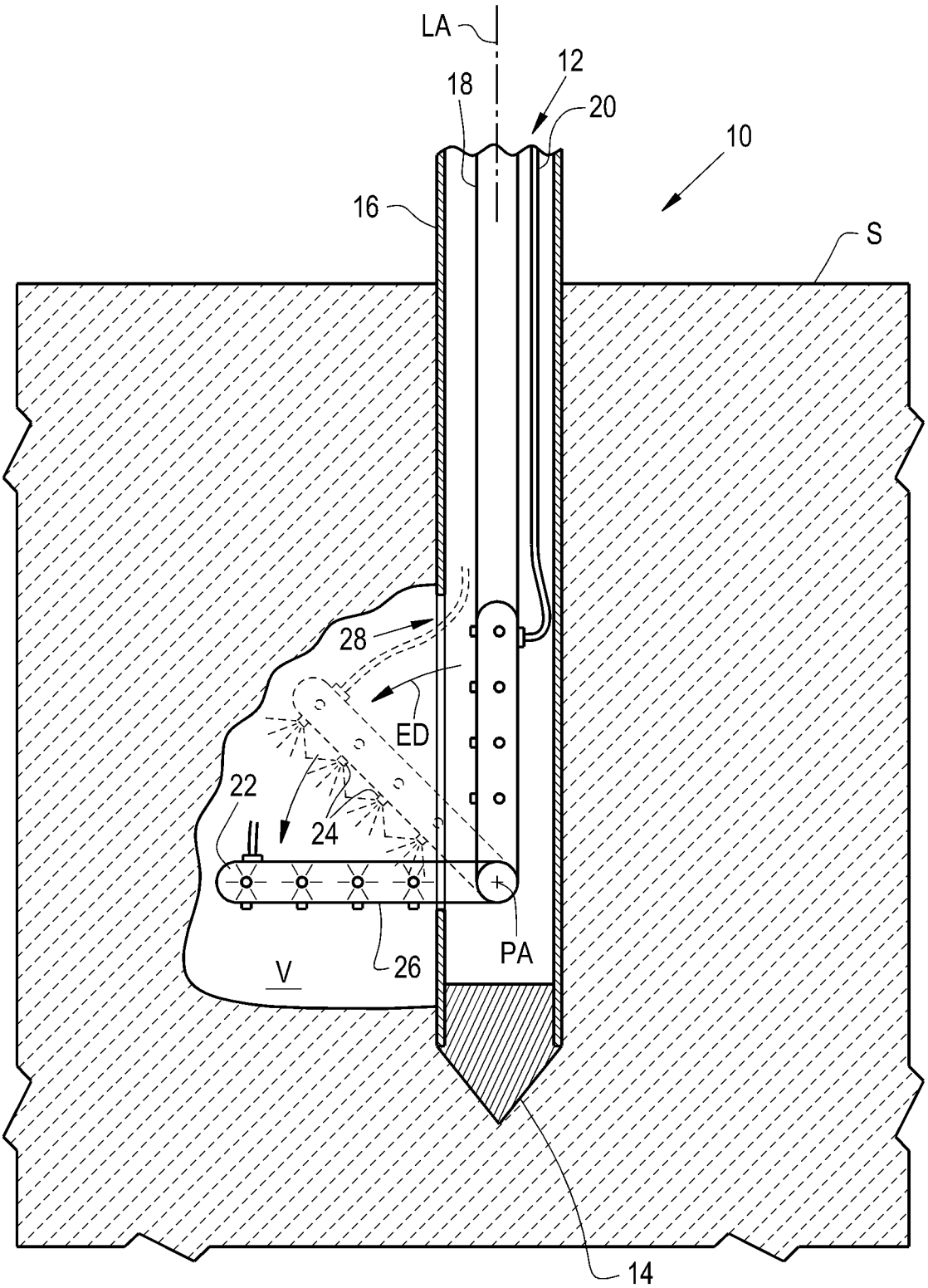
FIG. 1 is a cross-sectional side view illustrating an embodiment of a soil extraction/grouting device according to the present invention inserted into a soil.

Referring now to the drawings, and more particularly to FIG. 1, there is illustrated a soil extraction/grouting system 10 including a soil extraction/grouting device 12, a sacrificial point 14 and a casing 16 shown positioned in soil S. Extraction/grouting device 12 includes a rotatable member 18, a fluid conduit 20 and a pivoting wand 22. Pivoting wand 22 has a row of cutting nozzles 24 and a row of cutting nozzles 26. Pivoting wand 22 is pivotally coupled to rotatable member 18 about pivoting axis PA, allowing wand 22 to be extended in direction ED through a slot 28 in the side of casing 16. Rotatable member 18 is rotatable about a longitudinal axis LA, which also causes a rotation of wand 22 about axis LA.

Nozzles 24 are activated by pressurized fluid supplied through fluid conduit 20, which is attached to wand 22. Wand 22 has internal passageways and may have valves to variously direct the pressurized fluid. When nozzles 24 are activated the fluid that sprays therefrom softens and liquifies the local soil which flows up casing 16 and is extracted above the ground. As nozzles 24 spray, wand 22 is moved in direction ED, until deployed to a desired angle, which in FIG. 1 is perpendicular to longitudinal axis LA. As the soil is liquified and removed, a void V is formed where wand 22 has traveled. When wand 22 is at the desired angle nozzles 24 may be deactivated and nozzles 26 are activated to effect a soil removal in direction generally parallel with axis PA. Nozzles 24 provides an at least partially lateral spray relative to the longitudinal extent, and an at least partially radial spray as pivoting wand 22 is deployed.

Casing 16 is then either partially withdrawn from soil S, leaving sacrificial point 14 in soil S, and there by allowing extraction/grouting device 12 to be rotatable about axis LA, or casing 16 along with extraction/grouting device 12 are rotated about axis LA. As extraction/grouting device 12 is rotated nozzles 26 remove soil about an arc as wand 22 of extraction/grouting device 12 moves. Wand 22 can also be pivoted up and down as rotatable member 18 is rotated to create a hemispherically shaped void V in the event the rotation and pivoting action is completed for a full rotation of extraction/grouting device 12.

It is also contemplated that extraction/grouting device 12 can be vertically displaced in an up and down fashion while rotatable member 18 is rotated to thereby create a generally cylindrically shaped void V. Once the suitable void V is created, if desired, then a grouting material is supplied by extraction/grouting system 10 to void V to thereby exert pressure in soil S. The grouting may be supplied by way of extraction/grouting device 12, or after the removal of extraction/grouting device 12 from casing 16 (by forcing the grouting down casing 16), or by the insertion of another device into casing 16, not shown.

Figure 2:
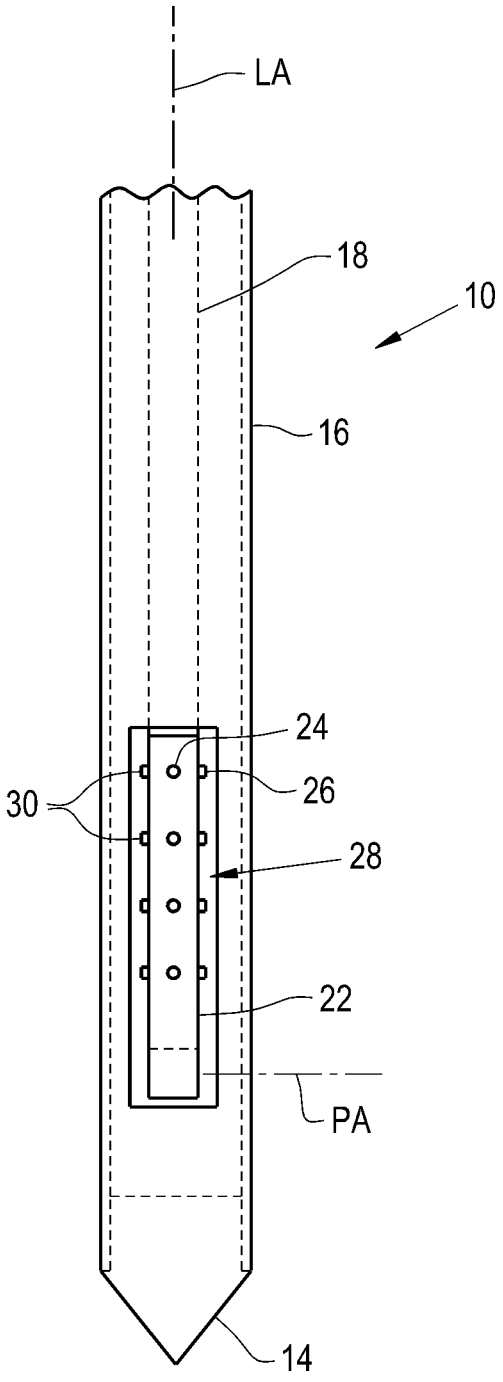
FIG. 2 is a side view of the extraction/grouting device of FIG. 1.

Now, additionally referring to FIG. 2 there is shown another view of the present invention rotated 90 degrees about axis LA from the view of FIG. 1, where slot 28 can be seen and an alternate row of nozzles 30 that allow fluid cutting/softening of soil S in an opposite direction from nozzles 26. As can be seen in the figures cutting nozzles 24, 26 and 30 are fixed to wand 22 and at least one of the cutting nozzles are directed parallel to pivoting axis PA of pivoting wand 22, at least one cutting nozzle being directed perpendicular to a direction of at least one other cutting nozzle on pivoting wand 22.

Figure 3:
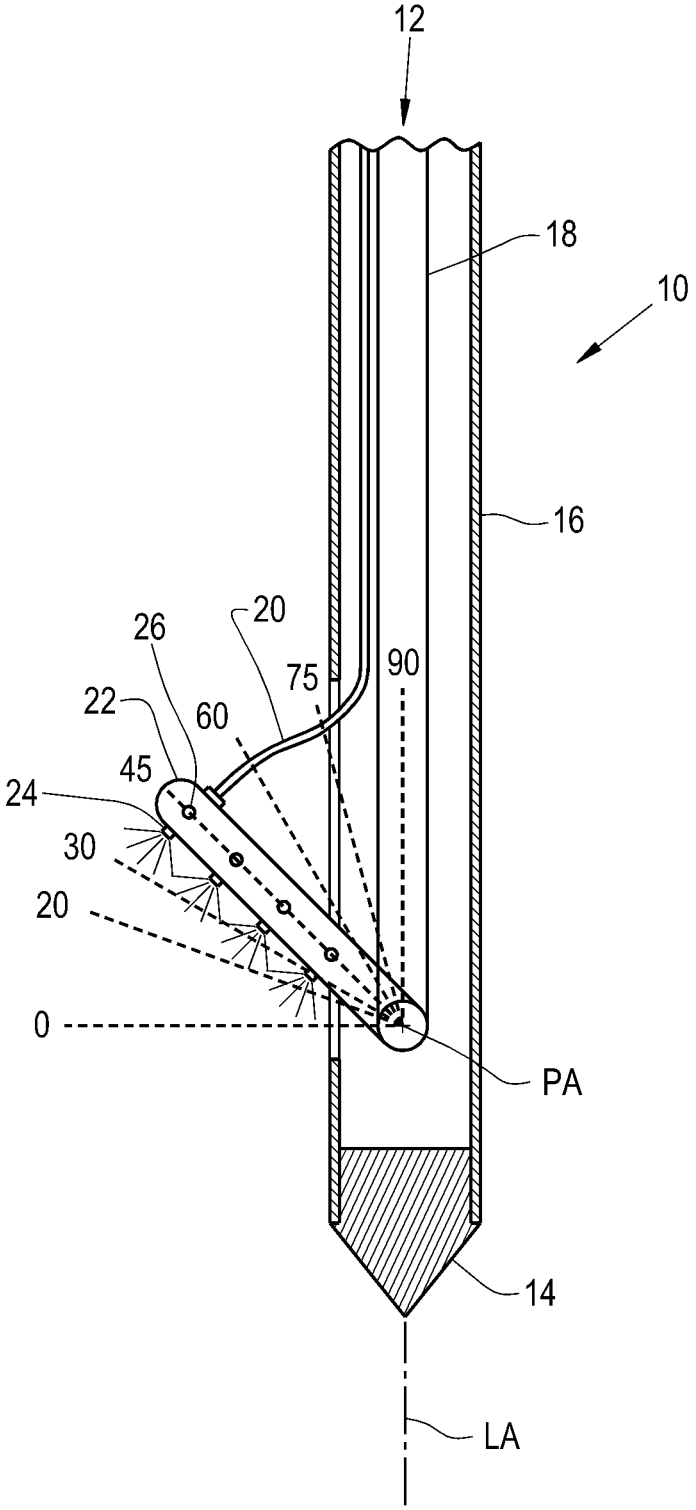
FIG. 3 is a partially sectioned side view of the extraction/grouting device of FIGS. 1 and 2.

Now, additionally referring to FIG. 3, there is illustrated a feature of the present invention in that wand 22 can be positioned at a selected angle, which is illustrated here at 45 degrees. This allows for a very selective shaping of void V to provide for tailored settling, movement, or vertical displacement of a selected structure or general shaping of the soil.

Figure 4:
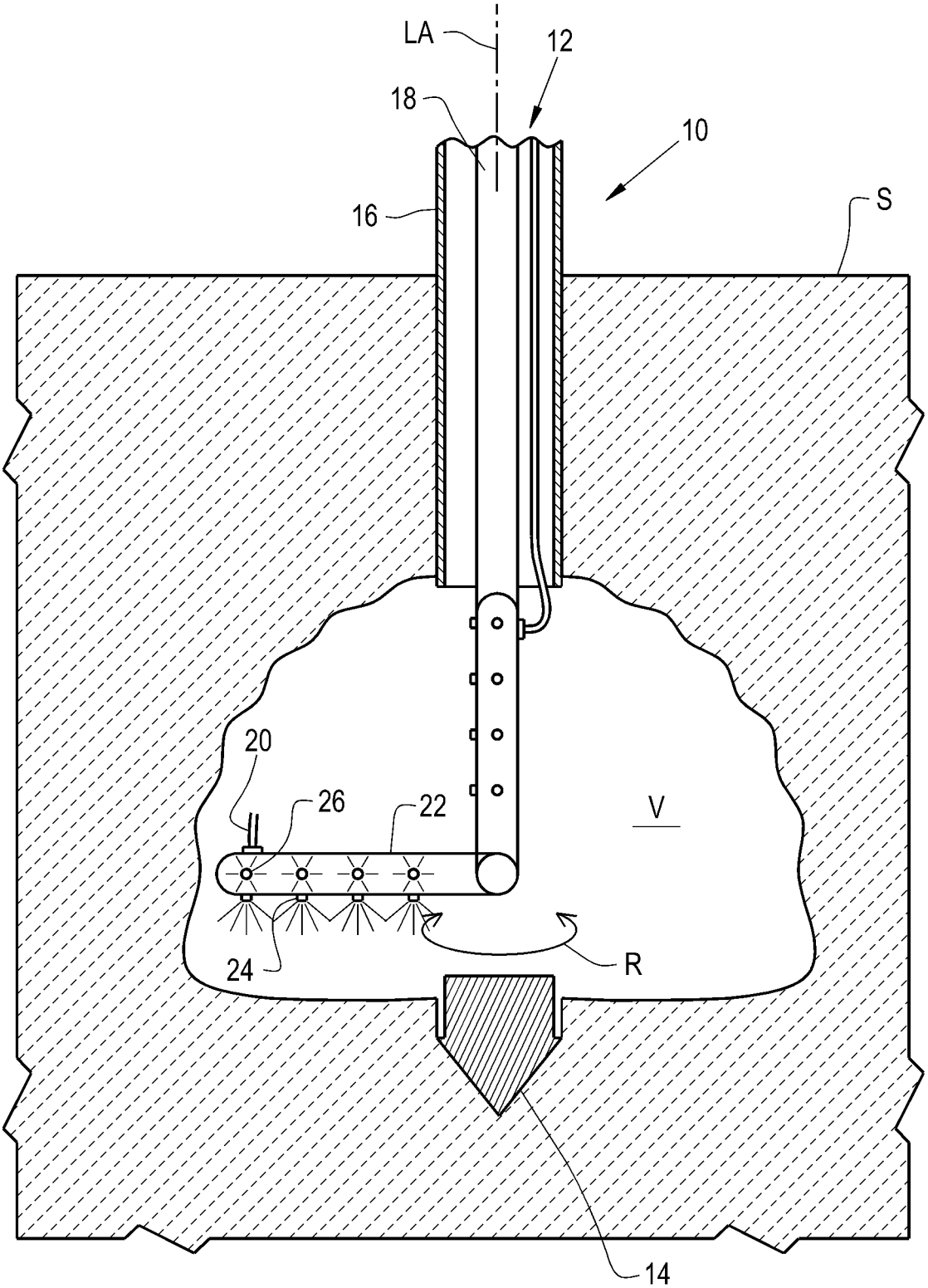
FIG. 4 is a partially sectioned side view of the extraction/grouting device of FIGS. 1-3 in situ with the pivoting extraction wand shown both stowed and extended.

Now, additionally referring to FIG. 4, there is illustrated the upward extraction of casing 16 (leaving point 14 in soil S) and the rotational movement of extraction/grouting device 12 about axis LA in a direction R. Here both nozzles 24 and 26 are being used to address the soil. The movements of wand 22 and the activation of nozzles 24, 26 and 30 are carried out by way of controls above ground with the control signals, pressures, or mechanical movements being conducted through an internal structure within rotatable member 18, depending upon the selected control method used in a specific rendition of the present invention.

Figure 5:
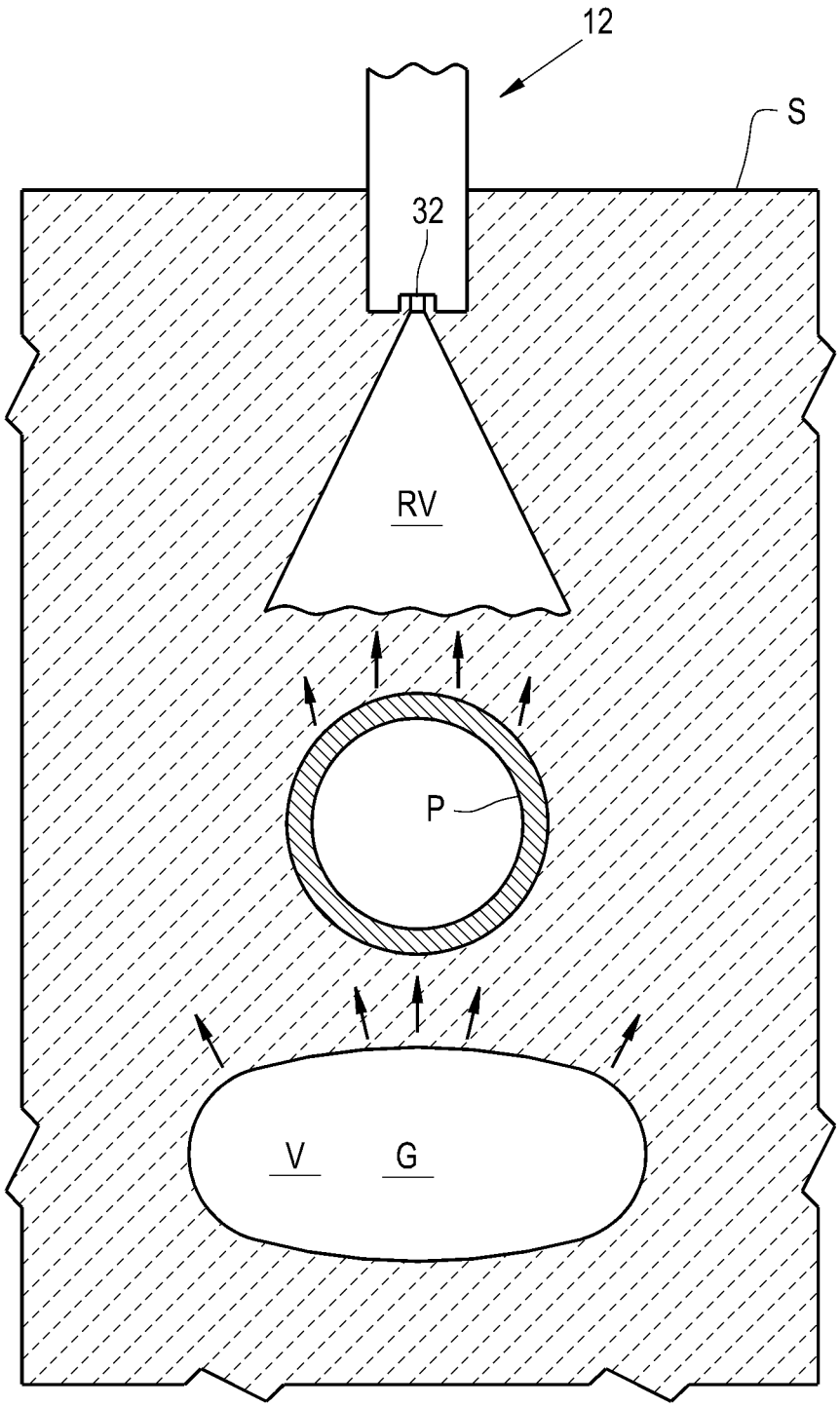
FIG. 5 illustrates the soil extraction/grouting device of the previous figures in situ with an underground pipe that is to be moved upward.

Now, additionally referring to FIG. 5, there is illustrated how a targeted structure P, here a pipe P is moved upward. Here a void V has been created beneath structure P with an extraction/grouting system 10, not illustrated here for the purpose of clarity, and another extraction/grouting device 12 is shown with a longitudinal nozzle 32 creating a release void RV. Nozzle 32 may be coupled to wand 22 or an end of member 18. Release void RV is created to remove soil above structure P to ease the downward pressure on structure P. As the movement arrows indicate, a pressurized grout G is inserted into void V causing upward movement of the soil above grout G causing structure P to move upward toward void RV. If structure P is a building, which extends above the surface of soil S, then of course no void RV would be utilized as grout G would be used to stabilize structure P, or to move structure P vertically. Alternately, void V could not be filled with grout and void V along with other voids beneath a structure P can be placed to cause a settling of structure P in a downward direction. With the precise application of voids and grouted voids along a structure a combination of movements can be applied to a structure to settle portions and to raise portions of the structure.

Figure 6:
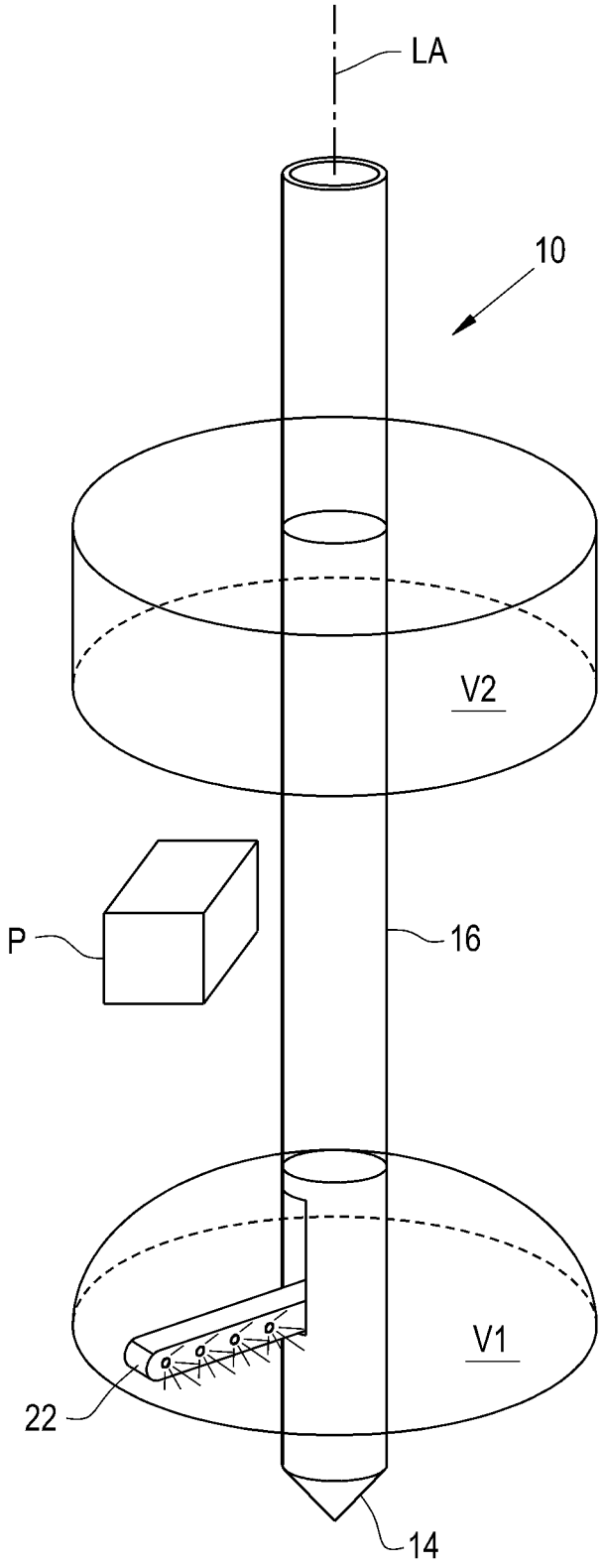
FIG. 6 is a perspective view of the extraction/grouting device of the previous figures schematically illustrating voids made in the soil.

Now, additionally referring to FIG. 6, there is illustrated the making of voids V1 and V2, with void V1 being hemispherically shaped and void V2 being cylindrically shaped. Voids V1 and V2 could be made sequentially in either order. For purposes of discussion, lets assume that void V2 is formed first to relieve soil from above a structure P, shown here in a schematic form, then void V1 is formed to extend beneath structure P. Then a grout is forced into void V1 to cause structure P to move upward. This is illustrated in another manner in FIG. 7, where two extraction/grouting systems 10 are used to accomplish the movement of structure P.

Figure 7:
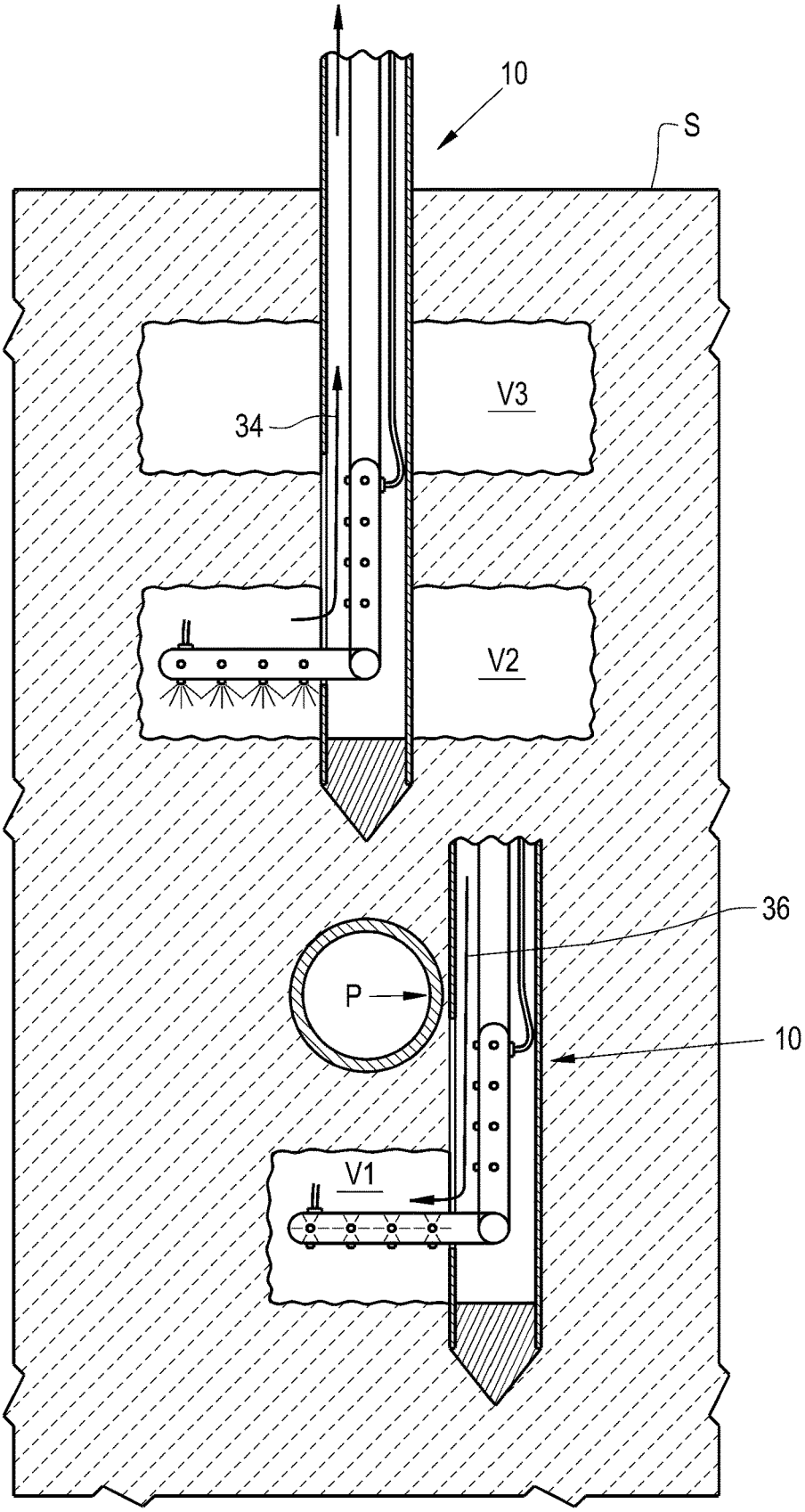
FIG. 7 is a sectioned side view of two extraction/grouting devices of the previous figures shown in the ground with an underground feature that is to be displaced.

Extraction/grouting systems 10 in FIG. 7, may illustrate two systems working in tandem, or sequential uses of one system 10. If used simultaneously then they may be offset along the extent of structure P so as to not physically interfere with each other. It is also contemplated the numerous systems 10 may be used along the extent of structure P. Here soil has been removed from void V3 and is being removed from void V2 in direction 34. Void V1 is semi cylindrically shaped, and grout is being applied as illustrated by arrow 36 to pressurize void V1 putting upward pressure on structure P.

Figure 8:
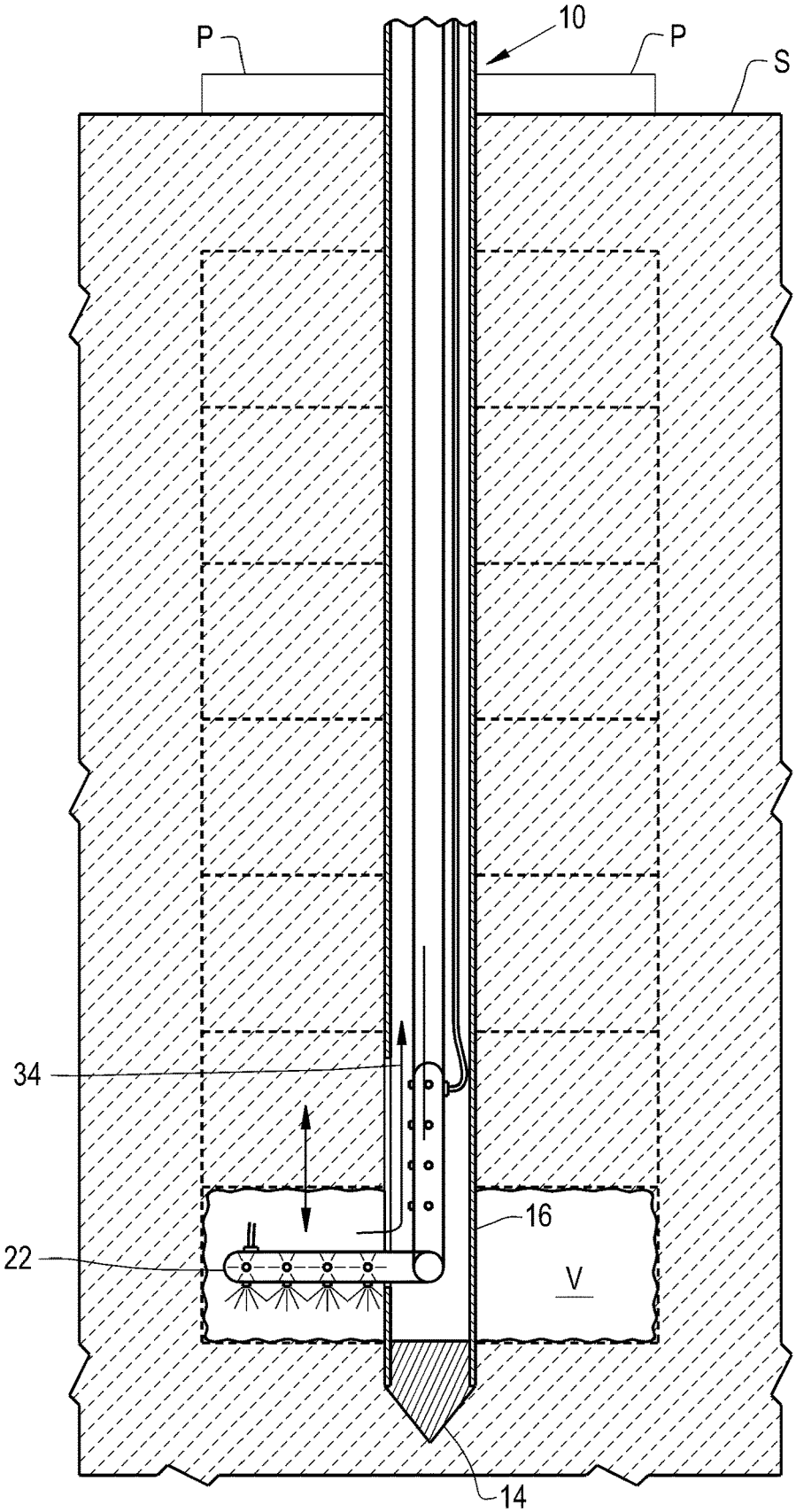
FIG. 8 illustrates the extraction/grouting device of the previous figures schematically illustrating how additional soil can be removed with the device of the present invention.

Now, additionally referring to FIG. 8, there is illustrated how system 10 can be moved vertically to selectively remove soil in sequential steps as illustrated in the dashed sections that can subsequently be formed to join void V. Here structure P is schematically shown above void V, which may be used to provide for a settling of structure P in a controlled manner.

The present invention includes the special tooling of system 10 as well as, pumps, casings, and directional fluid jets 24, 26, 30 and 32 are used to accomplish the soil extraction from deep within the ground without needing conventional excavation methods. The extraction process removes soil from predetermined locations and elevations below the surface of the ground. The manufactured cavities V, V1, V2, V3 allow the pressure grouting process, as compared to the prior art, to be:

More uniform in volume of grout placed;

More uniform in pressure required to place the grout;

More controlled as pressure and volume become more uniform;

More easily achieves the desired result; and

Minimally invasive.

Steel pipe or casings 16, typically varying in diameter from 2"-5" are driven or drilled into the soils beneath the structure P. Depending on the application and results desired, depths can range from just a few feet below the structure to much greater depths. Depending upon the cavity V size desired, soil types, or weight of the structure to be raised, a single-, double-, or quadruple-tipped nozzle arm 22 can be employed. Vertical or horizontal nozzles affixed to the arm can be self-rotating on manually rotated from the surface.

In preparation to create a cavity, utilizing one embodiment of the present invention, the installed casing or pipe 16 is first retracted a few inches to open the end of the pipe. The retraction separates the casing from the sacrificial drive point 14 or "lost" drill bit, exposing the surrounding soils. The special tooling arm 22 that does the cavity erosion can be referred to as a "jetting knife". Device 12 is next inserted into the pipe 16 and is positioned at the end of the casing at the exposed soil location. Once device 12 is set in position, water at high pressure is pumped through a hose 20 connected to the arm 22.

The high-pressure water activates the nozzles 24, which may be rotating tips 24 positioned at the edge of the jetting knife 22 that directs the erosive jets out, perpendicular to the axis of the jetting knife 22 and casing 16. The water jets 24 erode the adjacent soil and flush the eroded soil debris up the pipe 16 to a discharge chamber. The pressures and volumes are adjustable and are set based on cavity requirements, soil types, and density. Wand 22 is deployed outward about pivoting axis PA as the eroded soil debris continues to flow up casing 16.

Following the extraction of soils adjacent to/below the pipe as wand 22 pivots outward, horizontal jets 26 on the jetting knife 22 are activated and the jetting knife is manually, or by water pressure, activated to rotate about axis LA to create a cylindrical cavity V.

During the jetting and soil erosion process, the extracted soil and water is contained within the pipe casing 16 with a special cap that inhibits fluid loss out of the top. The cap also holds the jet packer assembly 12 in position and allows for easy vertical alignment adjusting for the heights of cavity V as required. The excess water and soil cuttings are directed out through a "T" connection above ground surface. Following the erosion and water flush steps, compressed air is forced through the jet packer 12 to purge remaining soil cuttings and water from the formed cavity V.

If utilizing the device 12 to collect soil samples or relics related to historical site investigations, fluid viscosities can be adjusted to extract heavy particles for collection.

Compaction Grouting: The process most applicable to stabilization of weak soils, and can also be used to raise structure P, which has settled. Its primary use is for soil densification for utility and foundation raising. Due to the lack of lateral confinement, compaction grouting is generally not effective nearer than about 10' of the surface or an unrestrained downslope. Although densification and raising are obtainable through compaction grouting and adaptable to a wide variety of soil types, it requires extensive investigation, planning, engineering, and with varying results. It also has difficulty lifting masonry, block, or stone foundations due to damage.

Advantages of the present invention: Applications have minimal disruption and duration since excavation is not required. Work can be performed from inside or outside of a particular structure. All cutting fluids are confined to the discharge hose, so no mess.

Installations are performed in ½-¼ of the time of compaction grouting requirements. Compaction grouting often requires primary, secondary, and tertiary grouting where the process using the present invention does not. Pipe and/or casing may also be left in place to expedite ongoing operations.

Most soil types can be compacted to greater densities to increase anticipated greater load requirements. Grouts can be contained to specific locations keeping material volumes low, prices down, limited duration for installation, and faster results in densification and raising. Results are predictable with structures in excess of 2½ inches of settlement or lift.

Due to the grout's containment, higher soil densities are achieved, with higher load-lifting capabilities and allows a structure to function as designed. The process of the present invention can lift stone, brick, or cinder block foundations uniformly without point-loading as with piers or piles and, to some extent, the same is true with compaction grouting.

The use of the present invention is far less likely to cause lateral damage to surrounding structure or utilities than conventional compaction grouting due to the forces being directed vertically, not laterally. Pressures are easily controlled and do not require extensive site investigation, planning, or soil analysis.

In the past, most grouting applications including results, feasibility, pressure application, performance, duration, costs, difficulty, disruption, material consumption, and volumes have been dictated by soil conditions. Many engineers and applicators have attempted to dictate otherwise. Attempting to take a specific soil site condition and say "I'm going to inject this material, at this location, at this pressure, at this volume, and get this result" and most fail to achieve the desired and/or predicted results.

Advantageously, this new inventive process allows for fairly predictable results due to the containment of grout in a preconceived/preconstructed location V.

Variable Applications: For very loose cohesive soils, such as sandy and/or silty soils, pre-grouting down the casing increases the cohesiveness of the soil allowing jetting to create a void within the solidified soil mass.

The pre-treatment grouting inhibits the soil from collapsing into the cavity V during the jetting operation and helps contain the grout, helping to create containment and increased soil densification. A grouted soil mass above the cavity also provides for a more uniform lift of the structure or element, limiting damage. This is especially useful on block, brick, or masonry structures. Greater containment of the grout also allows for higher pumping pressures for lifting heavy structures.

The extraction/grouting of the present invention is a process and system by which a soil is removed from deep within the ground without excavation. Soils are removed in predetermined locations and volumes for the purpose of replacing them with various grout composition, including cementitious, to increase soil densities or to raise whole or partial elements of a structure. One use of the present invention is to densify soils in order to increase their load-bearing capacities and stability beneath settled structures to inhibit further settlement or raise the settled segment. Another is to weaken soil cohesiveness and density to create soil consolidation to lower structures or infrastructure to a compromise level.

Six Soil Extraction Device Applications:

1. For the purpose of creating a cavity directly beneath a structure or element, above- or below-grade, to raise it. Particularly in constrained interior applications where high-water tables inhibit excavation without de-watering, or in contaminated soils where excavation is prohibitive.
2. To remove contaminated soils or fluids for collection and treatment and a means of washing the soils to better reclaim the contaminated product. Also, a means of introducing bacteria, enzymes, or other products to remediate contaminated soils.
3. To isolate contaminated soils via encapsulation.
4. To extract soils beneath a structure for the purpose of lowering the item to a comprise level. By accurately constructing a cylindrical cavity to exact dimensions and at specific elevations, soil consolidation can be calculated and predicable. If a more rapid approach is desired, cylindrical cavities can be enlarged, more can be installed, or at multiple elevations. Movement or total arrest can be initiated rapidly by filling any number of the cavities with a cementitious or foam grout, only to be reinitiated at a different elevation if so desired.

Once the extraction casing is in place, it can remain for weeks or years if needed to continue soil extraction operations as soils compress within the cavity to attain the desired elevation.

5. Soil extraction is a minimally invasive, rapid means of extracting soil samples at various elevations below ground or below old sensitive structures without excavation to locate historically significant sites of ancient civilizations. The process can be performed in lakes, rivers, and oceans when excavation is not possible and lidar and radar are ineffective.
6. To remove and then replace a weak soil or peat directly beneath a structure or element, to then replace the soils with a higher load-bearing product.

When heavy relics are found and due to their weight and depths located, it may be necessary to introduce a lower viscosity solution and air volume to retrieve the items for collection and evaluation.

The following four applications are particularly advantageous for the use of the present invention:

1. For lifting: pipelines, foundations, RR trackage, roadways, tunnels, reservoirs.
2. Contaminated soils: for washing to collect contaminants, for the removal of soils for collection and treatment, to extract and encapsulate a contaminant and then reintroduce the contaminant into the cavity from whence removed. Introducing enzymes or treatment products into contaminated soils on super fund sites or elsewhere.
3. Remove soils: to level pipelines, RR trackage, roadways tunnels, reservoirs, old historically significant structures in Europe and Asia, churches, libraries, castles, hotels, museums.
4. Collecting Historical information and artifacts: ancient sites or historically significant sites. Ancient civilizations.

The following site condition is used as an example of the use of the present invention with the method steps provided as the solution. The client desires to have an interior 6" diameter pipeline lifted to its original design elevation. Presently, the pipeline distress spans 16 linear feet with a maximum settlement of 3". Soils have been determined to consist of loose, sandy urban fill.

Step 1 Locate and Verify Pipeline Distress—This is performed by installing a sewer camera within the pipeline and using a surface sensor to locate the camera head location within the pipeline. A crayon, chalk, or masking tape can be used to mark the location of the pipeline at grade. By installing water within the pipeline, the height of the standing water is an excellent means of estimating the depth and span of the pipe settlement.

The exact below-grade location of the pipeline can also be determined using small diameter steel rods probing perpendicular to the pipe from above.

Step 2 Corrective Procedures-Following the verification of the pipeline location, depth, diameter, and the amount of settlement and spans, corrective procedures would be as follows:

A total of four (4) 3" diameter holes will be drilled through the slab on grade adjacent to the pipeline and the cores removed. The Pipeline Lifting Device (PLD) component casing 16 is then driven to a depth of 1 foot below the underside of the pipeline. Each system 10 will be offset on 3 foot centers along the span to be lifted. The internal lifting components to extract soil and lift the pipe are then inserted within the casings 16. Soils are displaced with systems 10, and the PLD arms are activated to a horizontal position followed by lifting the PLDs to contact the underside of the pipeline. Liquid spoils are collected in a tote designated to separate liquid (water) from soils.

Water and the sewer camera are then reinserted during the lifting process to monitor the lifting progress. Hydraulic rams are then used to lift the four PLDs simultaneously.

When grout is used, the control of the high pressure needed for densification, and especially for lifting, is key to the success of this process. The grout placement process is hydraulic, the larger the surface area contacted by the fluid under pressure directly impacts the extent of pressure required to achieve the desired results, and to move the load. The relationship as to the size of the fluid pool (the spread of the grout volume placed) and the load resistance (weight of the soil zone and structure) are proportional to the extent of pressure required to act on the fluid pool area and lift (move) the load.

The success of soil and settled structure remediation is dependent upon the ability of the installers and applicators to control the placement of the stiff mortar or foam pressure placed in measured volumes and at controlled high pressures.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of moving an installed underground pipeline, comprising the steps of:

verifying a location of the pipeline;

driving at least one casing into a soil proximate to the pipeline;

deploying a pivoting wand from the casing about a pivoting axis, the pivoting wand having a plurality of cutting nozzles that are coupled to a fluid conduit having a longitudinal extent in the casing relative to a longitudinal axis, the cutting nozzles being fixed to the wand and at least one of the cutting nozzles being directed parallel to the pivoting axis of the pivoting wand, at least one cutting nozzle being directed perpendicular to a direction of at least one other cutting nozzle on the pivoting wand;

pressurizing the fluid conduit to thereby send fluid through the cutting nozzle to soften the soil in a direction in which the wand deploys;

rotating the pivoting wand;

conducting the softened soil up through the casing to form a cavity in the soil proximate the pipeline, the cavity in the soil having a shape reflective of the movement of the pivoting wand in the rotating step;

positioning a lifting device beneath the pipeline; and lifting the pipeline with the lifting device thereby drawing the pipeline toward or into the cavity.

2. The method of claim 1, further comprising a step of inserting a material beneath the pipeline after the lifting step.

3. The method of claim 2, wherein the driving, deploying, pressurizing, rotating and conducting steps are repeated along a length of the pipeline before the positioning and lifting steps are carried out.

4. The method of claim 3, wherein the positioning step includes the positioning of a plurality of the lifting devices spaced along the length of the pipeline, before executing the lifting step.

5. The method of claim 4, wherein the lifting step is caried out with the plurality of lifting devices at the same time.

6. The method of claim 1, wherein there is a channel between the casing and the fluid conduit.

7. The method of claim 1, wherein a sacrificial point is coupled to a bottom of an end of the casing prior to the driving step, the sacrificial point allowing for displacement of soil as the casing is forced into the soil.

8. The method of claim 7, wherein the sacrificial point is fitted to the bottom end of the casing such that the sacrificial point will separate from the end of the casing when the casing is moved in an upward direction.

9. The method of claim 1, wherein the casing has a slot through which the pivoting wand extends, some nozzles on the pivoting wand are directed in opposite directions.

10. The method of claim 1, further comprising a step of purging the cavity with pressurized air to remove spoils and/or contaminants.

11. A buried pipeline lifting system, comprising:

an extraction/grouting system including:

a fluid conduit having a longitudinal extent along a longitudinal axis;

a pivoting wand;

a plurality of cutting nozzles in fluid communication with the fluid conduit, the cutting nozzles being coupled to the pivoting wand that is pivotably extendable relative to the longitudinal axis, the cutting nozzles being fixed to the wand and at least one of the cutting nozzles being directed parallel to the pivoting axis of the pivoting wand, at least one cutting nozzle being directed perpendicular to a direction of at least one other cutting nozzle on the pivoting wand; and a casing, the extraction/grouting device being movably extended at least partially within the casing; and a pipeline lifting device;

wherein the extraction/grouting system is used to carry out the following steps:

driving at least one casing into a soil proximate to the pipeline;

deploying a pivoting wand from the casing about a pivoting axis, the pivoting wand having a plurality of cutting nozzles that are coupled to a fluid conduit having a longitudinal extent in the casing relative to a longitudinal axis;

pressurizing the fluid conduit to thereby send fluid through the cutting nozzle to soften the soil in a direction in which the wand deploys;

rotating the pivoting wand; and conducting the softened soil up through the casing to form a cavity in the soil proximate the pipeline, the cavity in the soil having a shape reflective of the movement of the pivoting wand in the rotating step;

wherein the pipeline lifting device is used to carry out the following steps:

positioning the pipeline lifting device beneath the pipeline; and moving the pipeline with the pipeline lifting device thereby drawing the pipeline toward and/or into the cavity.

12. The buried pipeline lifting system of claim 11, wherein one of the extraction/grouting system and the pipeline lifting device is used to additionally carry out the following step:

inserting a material beneath the pipeline after the moving step.

13. The buried pipeline lifting system of claim 12, wherein the driving, deploying, pressurizing, rotating and conducting steps are repeated along a length of the pipeline before the positioning and moving steps are carried out by the pipeline lifting device.

14. The buried pipeline lifting system of claim 13, wherein the positioning step includes the positioning of a plurality of the pipeline lifting devices spaced along the length of the pipeline, before executing the moving step.

15. The buried pipeline lifting system of claim 14, wherein the moving step is caried out with the plurality of pipeline lifting devices at the same time.

16. The buried pipeline lifting system of claim 11, wherein there is a channel between the casing and the fluid conduit.

17. The buried pipeline lifting system of claim 11, wherein a sacrificial point is coupled to a bottom of an end of the casing prior to the driving step, the sacrificial point allowing for displacement of soil as the casing is forced into the soil.

18. The buried pipeline lifting system of claim 17, wherein the sacrificial point is fitted to the bottom end of the casing such that the sacrificial point will separate from the end of the casing when the casing is moved in an upward direction.

19. The buried pipeline lifting system of claim 11, wherein the casing has a slot through which the pivoting wand extends.

20. The buried pipeline lifting system of claim 11, wherein the fluid conduit is a high-pressure flexible hose.

* * * * *